US005667063A

United States Patent [19]

Abe

[11] Patent Number: 5,667,063

[45] Date of Patent: Sep. 16, 1997

[54] CONTAINER FOR RECORDING HEAD

[75] Inventor: Tsutomu Abe, Isehara, Japan

[73] Assignee: Canon Kabushiki Kaisha, Tokyo, Japan

[21] Appl. No.: 633,004

[22] Filed: Apr. 16, 1996

Related U.S. Application Data

[63] Continuation of Ser. No. 248,675, May 25, 1994, abandoned.

[30] Foreign Application Priority Data

May 25, 1993 [JP] Japan ..... 5-122617

[51] Int. Cl.[6] ..... B65D 81/26

[52] U.S. Cl. ..... 206/204; 206/723

[58] Field of Search ..... 206/204, 461, 206/462, 471, 701, 723

[56] References Cited

U.S. PATENT DOCUMENTS

| | | | |
|---|---|---|---|
| 4,720,410 | 1/1988 | Lundquist et al. | 206/204 |
| 5,024,865 | 6/1991 | Insley | 206/204 |
| 5,040,678 | 8/1991 | Lenmark, Sr. et al. | 206/204 |
| 5,074,418 | 12/1991 | Buan et al. | 206/471 |
| 5,131,539 | 7/1992 | Karita et al. | 206/462 |
| 5,231,416 | 7/1993 | Terasawa et al. | 206/334 |
| 5,231,425 | 7/1993 | Masuda et al. | 206/328 |
| 5,244,087 | 9/1993 | Hikake et al. | 206/471 |
| 5,279,410 | 1/1994 | Arashima et al. | 206/328 |

FOREIGN PATENT DOCUMENTS

| | | | |
|---|---|---|---|
| 0423374 | 4/1991 | European Pat. Off. . | |
| 0560266 | 9/1993 | European Pat. Off. . | |
| 1-124556 | 5/1989 | Japan . | |
| 1-153458 | 6/1989 | Japan . | |
| 81/01825 | 7/1981 | WIPO | 206/204 |

*Primary Examiner*—Jimmy G. Foster

*Attorney, Agent, or Firm*—Fitzpatrick, Cella, Harper & Scinto

[57] ABSTRACT

A container for containing at least an ink jet head cartridge, including a main body, having an opening, for containing an article including at least the recording head cartridge; a covering member for covering the opening; and an ink retaining portion in the main body for retaining, using capillary force, ink or another liquid leaked out of the article.

9 Claims, 7 Drawing Sheets

CONTAINER FOR RECORDING HEAD

This application is a continuation of application Ser. No. 08/248,675 filed May 25, 1994, now abandoned.

FIELD OF THE INVENTION AND RELATED ART

The present invention relates to a container for a recording head serving as an ink ejecting means, which is used with an ink jet recording apparatus for effecting recording by ejecting ink.

In the field of ink let recording, an ink jet cartridge has been proposed which integrally has a recording head portion and an ink container portion, and which is detachably mountable as a unit on a carriage movable for recording, from the standpoint of the downsizing of the apparatus and easy maintenance and so on.

FIG. 1 shows an example of such an ink jet cartridge IJC. In the Figure, 100 designates a recording head; 200, ink container. They are integral with each other. An ink container 200 is provided with an air vent 23 for allowing the inside of the ink container 200 to communicate with the ambience. The recording head is provided with an ejection outlet or outlets 9 for ejecting ink.

An ink jet cartridge IJC of this structure is preferably hermetically sealed at the opening portions to prevent leakage of the ink therein, when the ink jet cartridge IJC is transported. In this example, ejection side surface 26 provided with the ejection outlets 9 and the air vent 23 are sealed by a seal 22, and in addition, the ejection side surface 26 is pressed by a pressing member 21 having an elastic portion 21*a*. The thus sealed ink jet cartridge IJC is contained in a container 25, and the opening thereof is covered with a covering member 24. Then, they are sealed by heat-sealing or the like.

When the ink in the ink container 200 is used up, the recording head 100 is also exchanged. However, at this time, the recording head 100 may have sufficient service life remaining, and therefore, it is wasteful to exchange the recording head 100 also at this stage.

Under the circumstances, a proposal has been made in which the recording head 100 and the ink container 200 are made separable from each other. In use, they are integral on a carriage. After the ink container 200 becomes empty, only the ink container 200 is exchanged.

With such a structure, the recording head is packaged separately. The recording head 100 is filled with ink or clear ink for the purpose of prevention of oxidation of its heaters. Therefore, as shown in FIG. 2, the ejection side surface 26 is sealed by a seal 22, and an opening of ink supply port 2200 for receiving ink supplied thereto, is covered with a cap 30. Then, it is placed in a container, which, in turn, is capped. Thus, it is packaged.

Thus, in packaging the recording head 100 per se, the ejection side surface and an ink supply port 2200 are firmly sealed by a seal 22 or a cap 30. This structure means that the number of parts is large with the result of high cost. In addition, there is a problem of cumbersomeness in that they have to be removed upon mounting the main assembly of the recording apparatus, or otherwise, a trouble caused by mounting it without removing them. In case that pressure balance in the package is disturbed during transportation, as a worst situation, the seal 22 covering the ejection outlets 9 and/or the cap 30 for the ink supply port 2200, are removed with the possible result that the ink leaks out of the recording head 100. If this occurs, the ink in the package moves around the package, and the recording head 100 may be contaminated with the ink.

In this case, the ink may be deposited on electrodes 31 of the recording head 100 for transmitting record signals, resulting in oxidation of the electrodes, and therefore, decreased reliability of the recording head 100.

SUMMARY OF THE INVENTION

Accordingly, it is a principal object of the present invention to provide a container for a recording head which is inexpensive, simple in construction and easy to manufacture and mount.

It is another object of the present invention to provide a container for a recording head with which even if the ink or the like is leaked out, the recording head is not contaminated with the ink.

According to an embodiment of the present invention, there is provided a container for containing at least an ink jet head cartridge, including a main body having an opening, for containing an article including at least the recording head cartridge; a covering member for covering the opening: and an ink retaining portion in the main body for retaining using capillary force, ink or another liquid that has leaked out of the article.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, a container according to an embodiment of the present invention will be described.

Figure 3:
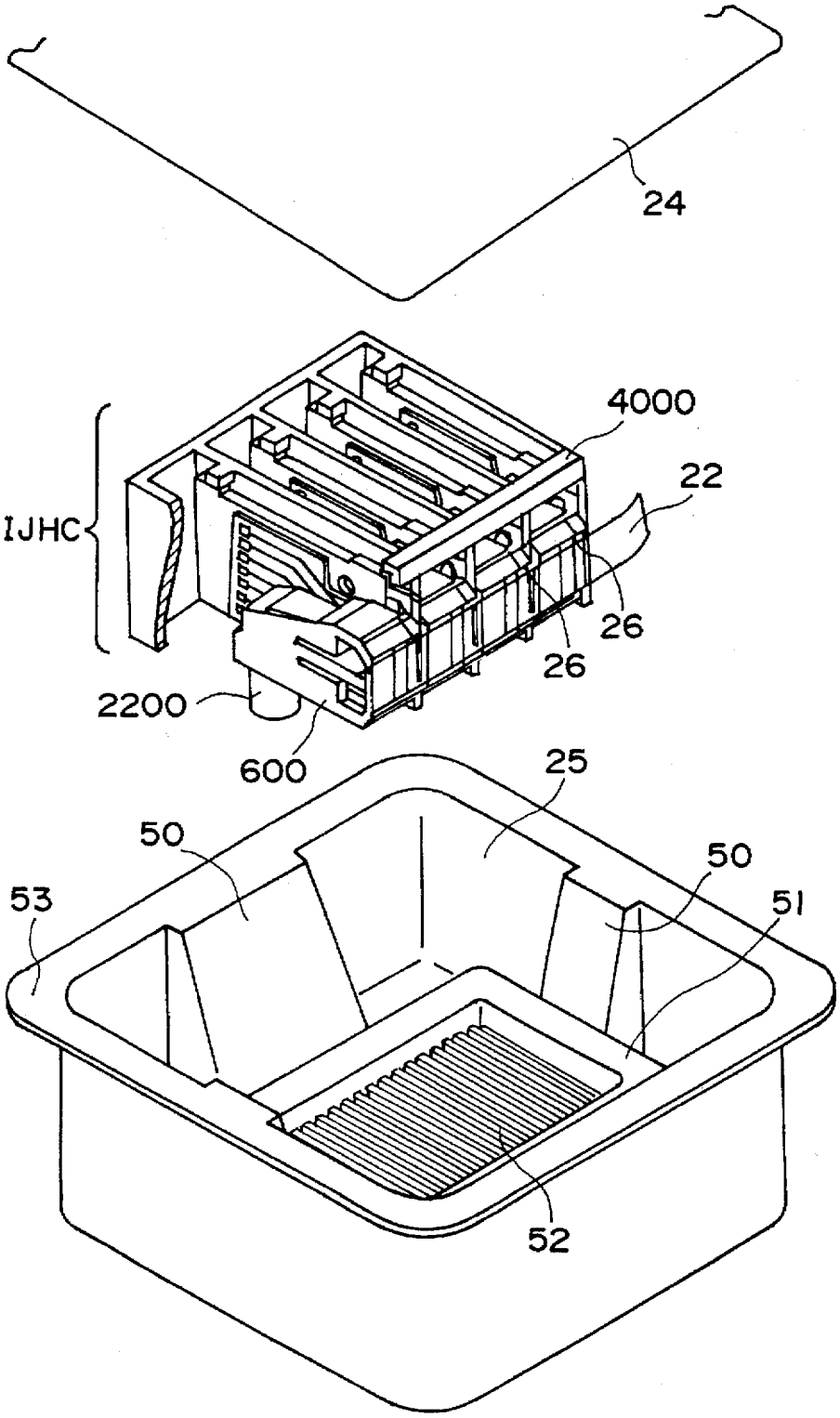
FIG. 3 is an exploded perspective view of a container according to an embodiment of the present invention.

FIG. 3 is a perspective view of an exemplary container, in which an ink jet head cartridge IJHC is also contained.

Figure 1:
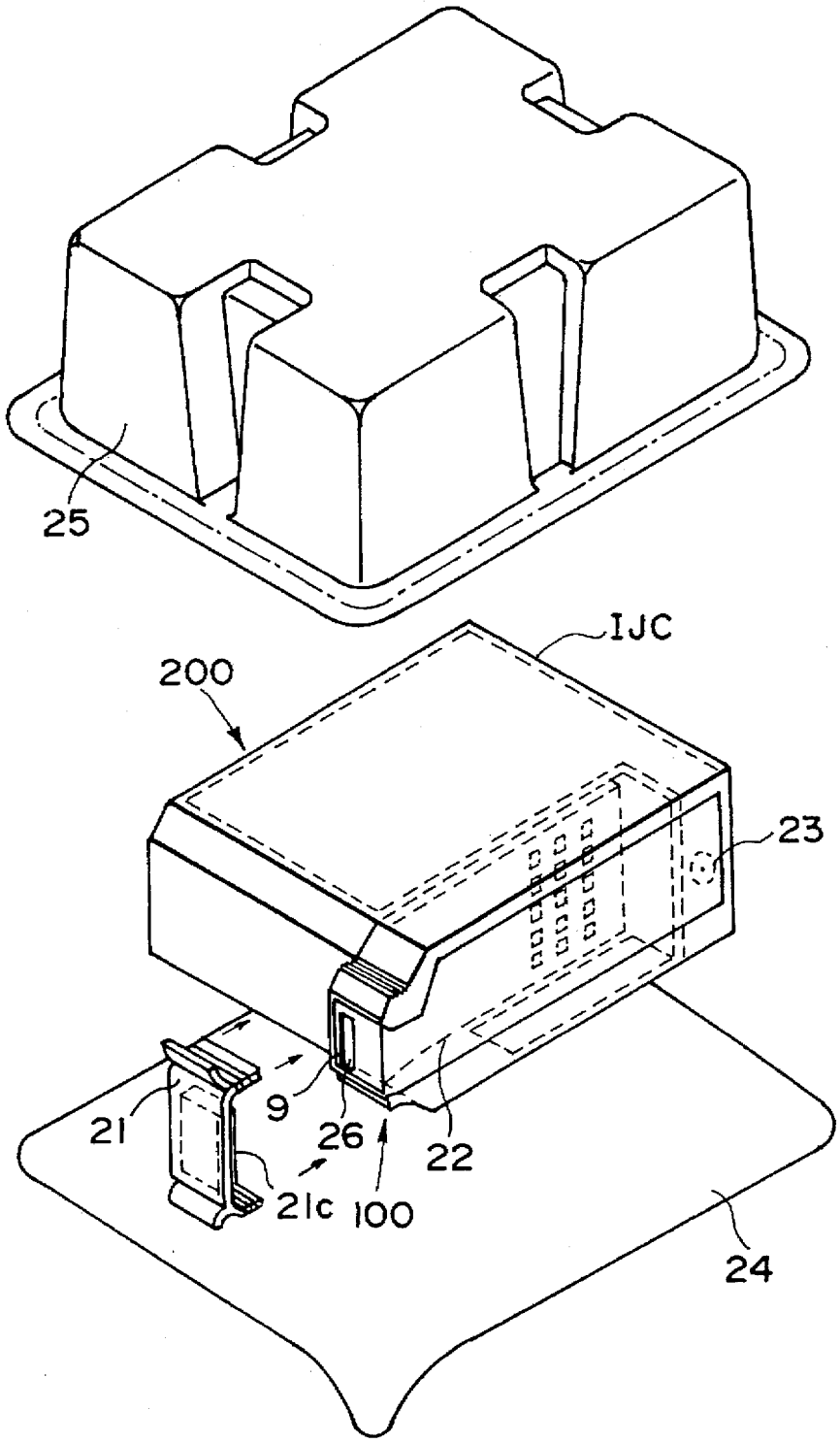
FIG. 1 PRIOR ART
FIG. 1 is a perspective view of a conventional example of an ink jet head cartridge container.
Figure 2:
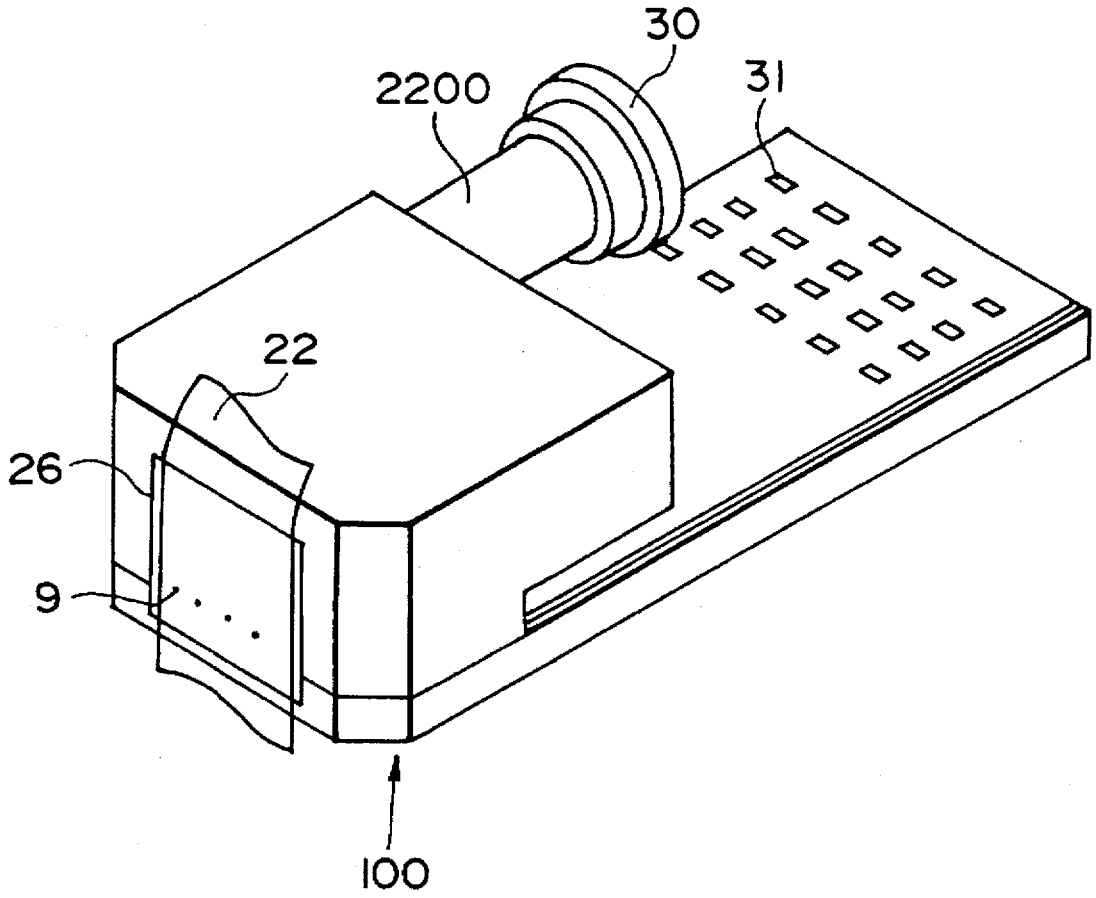
FIG. 2 PRIOR ART
FIG. 2 is a perspective view of a conventional example of a container for a recording head.

The ink jet head cartridge IJHC of this embodiment has four integral recording heads, as shown in FIG. 2. They are supported on a frame 4000. Such an ink jet head cartridge IJHC is sealed by a common seal 22 for the four recording heads, at the ejection side surface 26.

Each of an ink supply port 2200 for ink supply, is exposed without cap 30, as contrasted to the case of FIG. 2. Although not shown, adjacent to an opening of the ink supply port, there is provided a filter so that the ink or clear ink contained in the recording head does not easily leak out to the outside.

Such an ink jet head cartridge IJHC is contained in a container body 25 such that the frame 4000 of the ink jet head cartridge IJHC is supported by four head supporters 50 projected from respective inside surfaces of the main body of the container 25.

Designated by a reference numeral 51 is a receptor for receiving a bottom side of the frame 4000 (the side having the ink supply port), by which the ink jet head cartridge IJHC is supported by the supporters 50 at the peripheral four sides and by the receptor 51 and a covering member 24 for covering an opening of the container body 25 in the vertical direction. Designated by a reference numeral 52 is an ink retaining portion provided on a bottom wall of the container 25, which is faced to an ink supply port 2200 of the ink jet head cartridge IJHC.

Figure 4:
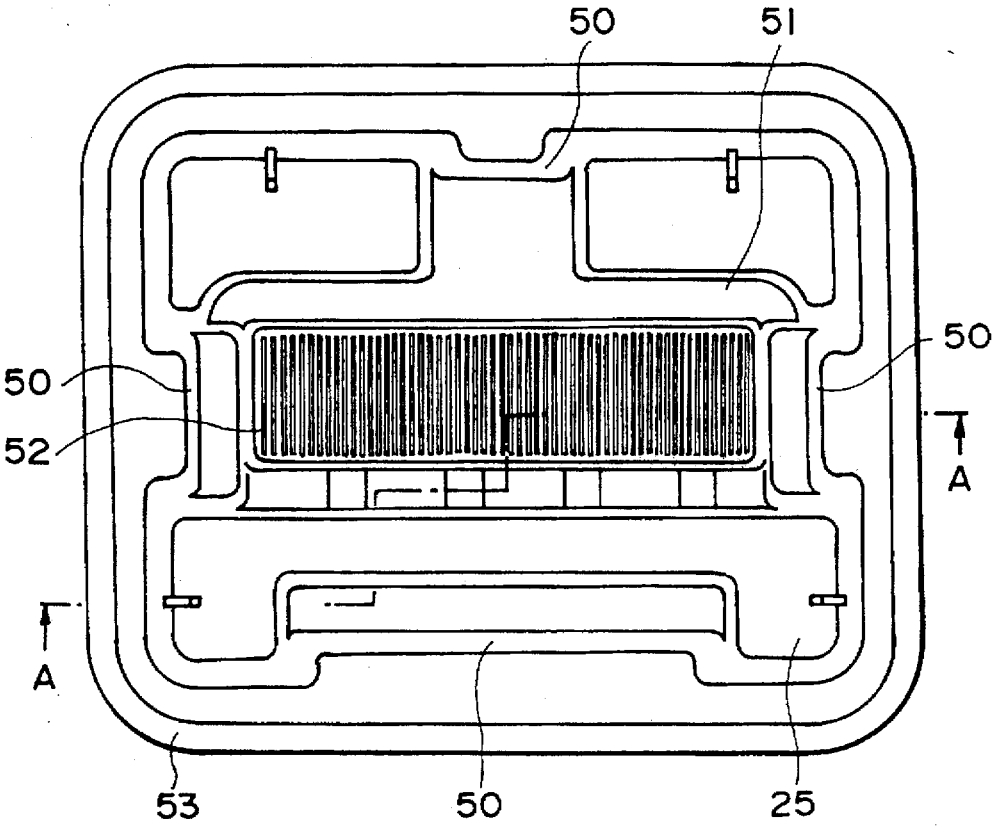
FIG. 4 is a plan view of a main body of the container of FIG. 3, as seen from an opening.
Figure 5:
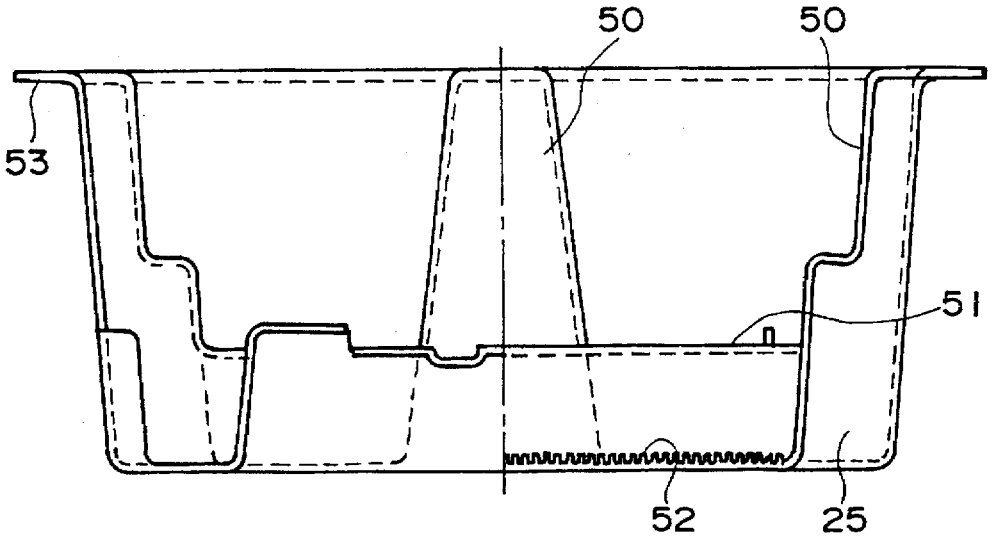
FIG. 5 is a sectional view taken along a line A—A of FIG. 4.
Figure 6:
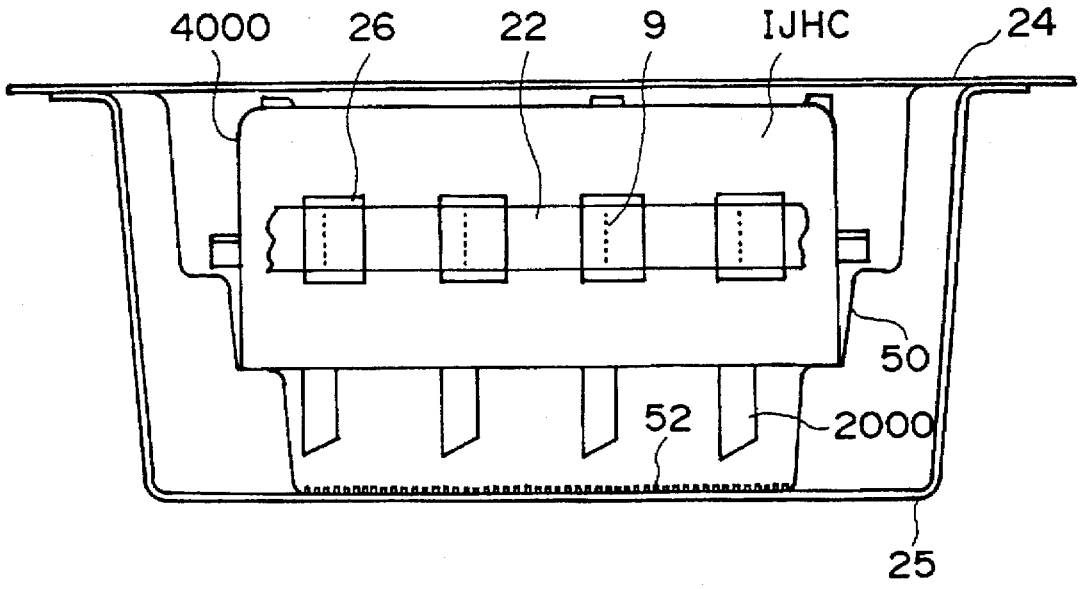
FIG. 6 is a sectional view illustrating a package for an ink jet head cartridge according to an embodiment of the present invention.

FIG. 4 is a plan view, as seen from the container body 25. FIG. 5 is a cross-sectional view taken along a line A—A of FIG. 4. In FIG. 6, the ink jet head cartridge IJHC has been packaged. As will be understood from this Figure, ink holder 52 is located below the receptor 51 of the ink jet head cartridge IJHC, and has a corrugated surface. The ink jet head cartridge IJHC is enclosed by the receptor 51 and supporters 50. Thus, even if the recording ink or clear ink in the ink jet head cartridge IJHC leaks out through the ink supply port 2200 and the ink jet head cartridge IJHC is subjected to impact or vibration during transportation, it can be avoided that ink or the clear ink moves within the container 25 and that the ink deposited on the periphery of the ink jet head cartridge IJHC including the electrode, or that the inside of the container is contaminated. The ink retaining portion 52 can retain the ink or clear ink.

In other words the ink retaining portion 52 comprises the grooves which can retain the ink by capillary force, thus preventing the leaked ink to move.

In the illustrated example, the ink retaining portion 52 is formed only on one surface adjacent to the ink supply pore 2200 of the ink jet head cartridge, but it may be formed on each of a plurality of inside surfaces of the container 25. In the latter case, the quantity of stored ink or clear ink is increased, and in addition, the deposition of the ink on the ink jet head cartridge can be more effectively prevented.

Figure 7:
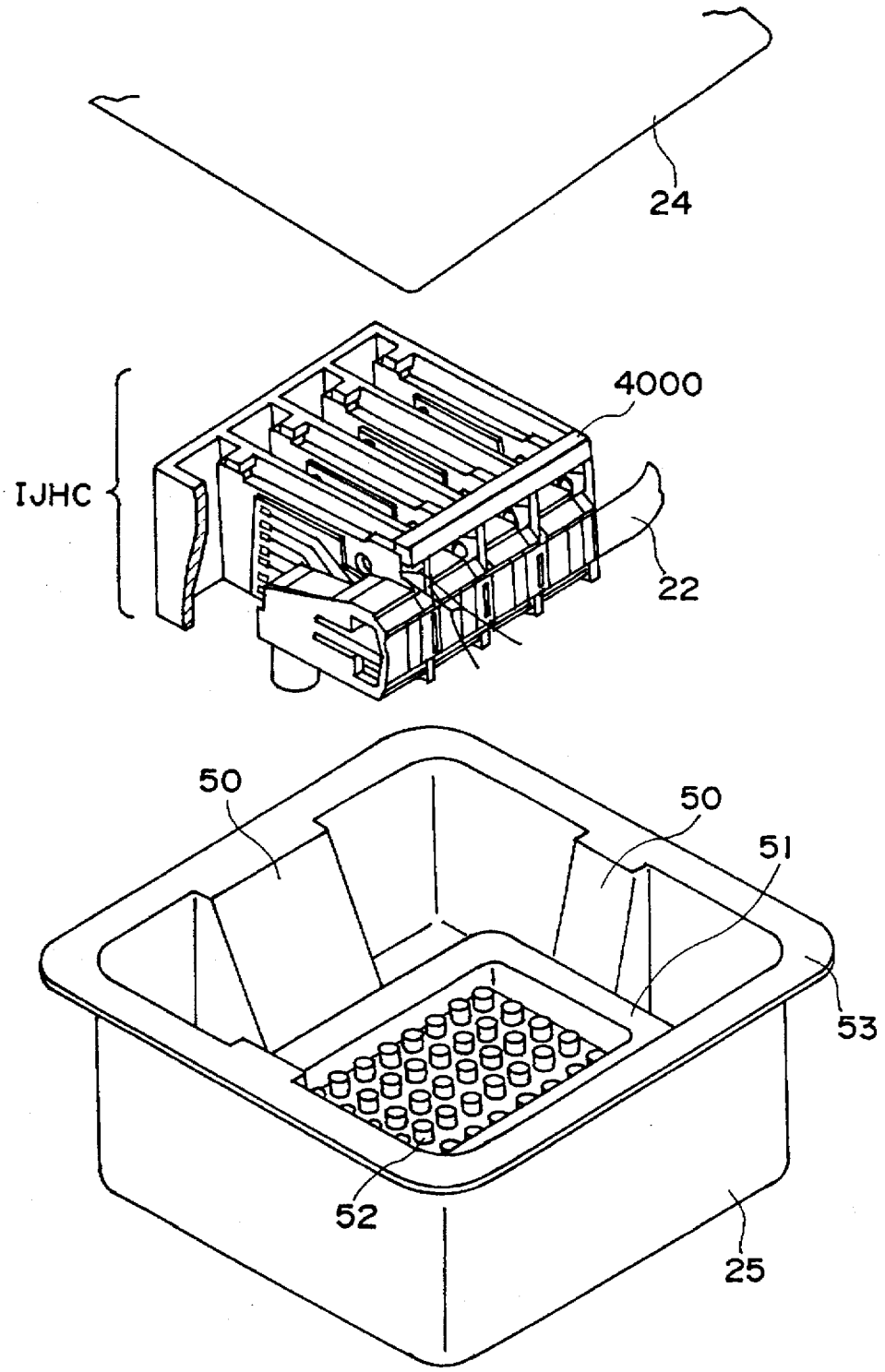
FIG. 7 is an exploded perspective view of a container according to a further embodiment of the present invention.

The configuration of the ink retainer 52 is not limited to the corrugated configuration. Alternatively, it may include small bosses, as shown in FIG. 7, In this case, the ink is retained between adjacent bosses. For the purpose of assured retention of the ink, the adjacent bosses are preferably spaced by 1–2 mm. Further alternatively, the ink retaining portion 52 may be in the form of wrinkles.

Figure 8:
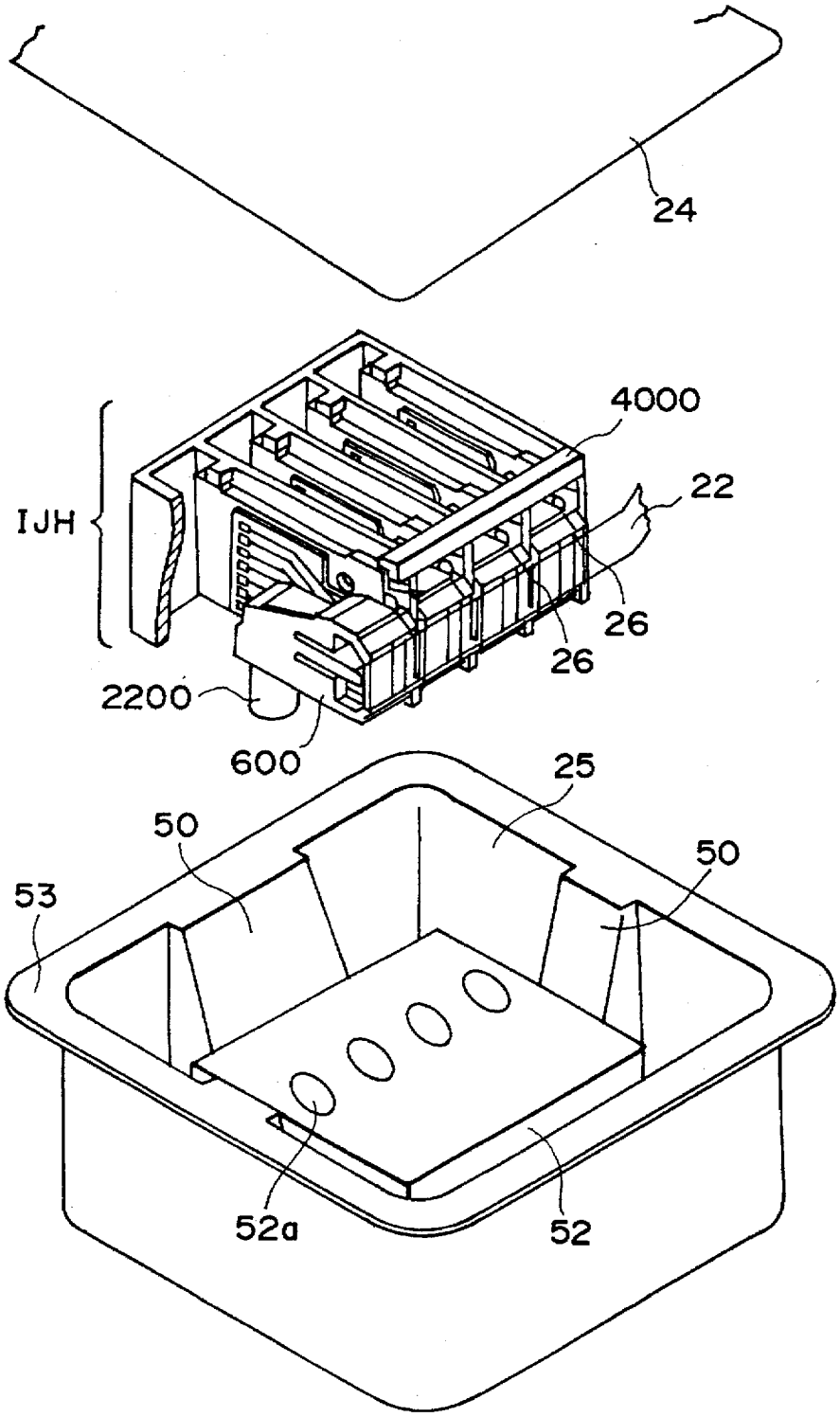
FIG. 8 is an exploded perspective view of a container according to a further embodiment of the present invention.

FIG. 8 is a perspective view of a container according to a further embodiment, in which the ink retaining portion 52 is made of a liquid absorbing material. Four holes 52*a* are formed to receive the ink supplying port 2200 of the ink jet head cartridge IJHC. The portion of the frame 4000 adjacent the supply port is directly supported by the ink retaining portion 52 of the absorbing material. By employing the structure in which the opening of the ink supply port 2200 is positioned in the absorbing material, any ink or clear ink leaking from the ink supply portion 2200 is assuredly absorbed by the ink absorbing material, and therefore, the motion of the ink in the container can be prevented irrespective of the pose taken by the package.

In the case of the grooves and bosses, the ink or the clear ink is not assuredly retained, depending on the position of the package, as the case may be. By the use of the absorbing material as the ink retaining portion 52, this problem is avoided.

In this Figure, the absorbing material is thick enough to support the frame 4000. However, also may have a thickness equivalent to the depth of the grooves or the height of the bosses shown in FIGS. 4 or 7 (preferably, the thickness permitting an end of the ink supplying port member 2200 to be inserted slightly into an associated opening 52*a*), with similar advantageous effects.

As a further example, the absorbing material shown in FIG. 8 may be overlaid on the grooves or the bosses shown in FIG. 3 or 7. In this case, even if a great amount of ink leaks out, the capillary forces of the absorbing material and the grooves or the bosses are used to retain the ink, and therefore, the reliability is further enhanced.

As described in the foregoing, according to the present invention, a container having an ink jet head cartridge accommodating space, is provided with an ink retaining portion for retaining the ink or the like leaked out of the ink jet head cartridge by the capillary force. Therefore, motion of the ink within the container even if it is leaked out by physical or mechanical shock during the transportation, can be prevented. Therefore, contamination of the ink jet head cartridge and contamination of the electrode, can be prevented, so that the ink jet head cartridge can be kept with high reliability. In the foregoing description, the container has been described as containing only a recording head, but is applicable for a cartridge having integral recording head and ink container, or an ink container cartridge or the like, if it involves a liability of ink leakage.

While the invention has been described with reference to the structures disclosed herein, it is not confined to the details set forth and this application is intended to covet such modifications or changes as may come within the purposes of the improvements or the scope of the following claims.

What is claimed is:

1. A container for containing at least an ink jet head cartridge, said ink jet head cartridge having a plurality of sealed ink ejection outlets and an unsealed member defining an ink supply port, said container comprising:

a main body, having an opening, for containing an article including at least the ink jet head cartridge, said main body including a first supporting portion for supporting said ink jet head cartridge so as to prevent contact between said main body and the ejection outlet of said ink jet head cartridge, and a second supporting portion for supporting said unsealed member;

a covering member for covering the opening; and an ink retaining portion disposed in said main body at a bottom of said container, for retaining, using capillary force, an ink or an other liquid which has leaked out from the article, wherein said second supporting portion is disposed around said ink retaining portion, and said second supporting portion prevents contact between said unsealed member and said retaining portion.

2. A container according to claim 1, wherein said retaining portion has a plurality of fine grooves.

3. A container according to claim 1, wherein said retaining portion has a plurality of fine bosses.

4. A container according to claim 1, wherein said retaining portion includes a liquid absorbing material.

5. A container according to claim 4, wherein said absorbing material is provided with an opening for receiving said unsealed member defining said ink supply port.

6. A container as in claim 1, wherein said retaining portion is also provided on a side wall of said container.

7. A container as in claim 1, wherein said ink supply port is provided with a filter adjacent to an end of the port.

8. A container according to claim 1, wherein said container further comprises said ink jet head cartridge.

9. A container according to claim 8, wherein said ink jet head cartridge further comprises the ink.

* * * * *

UNITED STATES PATENT AND TRADEMARK OFFICE

CERTIFICATE OF CORRECTION

PATENT NO. : 5,667,063

DATED : September 16, 1997

INVENTOR(S) : TSUTOMU ABE

It is certified that error appears in the above-identified patent and that said Letters Patent is hereby corrected as shown below:

COLUMN 1

Line 12, "let" should read --jet--.

COLUMN 2

Line 22, "opening:" should read --opening;--.

COLUMN 4

Line 12, "also" should read --it also--; and
Line 44, "covet" should read --cover--.

Signed and Sealed this

Twenty-fourth Day of February, 1998

*Attest:*

Bruce Lehman

BRUCE LEHMAN

*Attesting Officer*

*Commissioner of Patents and Trademarks*